United States Patent [19]

Charbonnier

[11] 4,391,090

[45] Jul. 5, 1983

[54] DEVICE FOR PNEUMATICALLY THREADING A YARN IN A DOUBLE TWIST SPINDLE

[75] Inventor: Simon Charbonnier, Lyons, France

[73] Assignee: Verdol S.A., Caluire, France

[21] Appl. No.: 308,969

[22] Filed: Oct. 6, 1981

[30] Foreign Application Priority Data

Nov. 3, 1980 [FR] France ..... 80 23666

[51] Int. Cl.[3] ..... D01H 15/00; D01H 7/86

[52] U.S. Cl. ..... 57/279; 57/58.86

[58] Field of Search ..... 57/58.49, 58.86, 58.7, 57/279, 280

[56] References Cited

U.S. PATENT DOCUMENTS

| | | | |
|---|---|---|---|
| 4,168,605 | 9/1979 | D'Agnolo | 57/279 |
| 4,199,929 | 4/1980 | Vessella | 57/279 |
| 4,281,508 | 8/1981 | Frentzel-Beyme | 57/279 |
| 4,354,343 | 10/1982 | D'Agnolo et al. | 57/279 |

FOREIGN PATENT DOCUMENTS

| | | | |
|---|---|---|---|
| 2024878 | 1/1980 | United Kingdom | 57/279 |

*Primary Examiner*—John Petrakes

*Attorney, Agent, or Firm*—Dowell & Dowell

[57] ABSTRACT

The invention relates to a device for pneumatically threading a yarn in a double twist spindle. It is disposed inside a sleeve connecting two tubes adapted to constitute the central shaft of a double twist spindle. A yarn brake capsule passing through the flat rod of a piston is disposed inside the sleeve, its ends abutting against the opening of the bore of one tube and against that of the central hole of an end piece mounted at the end of the other tube. When compressed air is sent into the bore of the first tube, the piston is moved, causing a lateral shift of the yarn brake capsule, thus allowing passage of the yarn along the bore of the spindle. The invention is particularly applicable to double twist spindles.

5 Claims, 5 Drawing Figures

1
1a
5
1c 4
8a
1b
3a
9
14
8
13c
12
13
10
13a
II
11
II
13b
8b
6b
6
6c
6d
7
4'
6a
3
2c
5
2a
2

DEVICE FOR PNEUMATICALLY THREADING A YARN IN A DOUBLE TWIST SPINDLE

The present invention relates to improvements in systems for pneumatically threading the yarn in the bore of a double twist spindle, this bore being provided with a yarn brake.

U.S. Pat. No. 4,199,929 to Vassella describes a device of this type which is entirely satisfactory from the technical standpoint. Unfortunately, it is difficult to make and it comprises a large number of parts, with the result that its cost price is high.

It is an object of the improvements according to the present invention to overcome the drawbacks of the above-mentioned prior art.

The pneumatic threading device according to the invention comprises a very small number of parts. Its, construction is therefore very economical. Instead of providing two bores side by side in the spindle, the compressed air used by the device according to the invention is introduced into this spindle via its usual bore through which the yarn to be twisted passes. The spindle is made by two tubes connected by a connecting sleeve in which are disposed means for laterally displacing the yarn brake with respect to said bore when the pressurised air is introduced therein. The yarn brake, which is in the form of a conventional telescopic capsule, then disengages the bore and enables a yarn placed at the head of the spindle to be freely introduced into its bore.

The yarn is introduced by means of a pistol, such as the one described in U.S. Pat. No. 4,199,929.

The invention may be more readily understood on reading the following description with reference to the accompanying drawings, in which.

Figure 1:
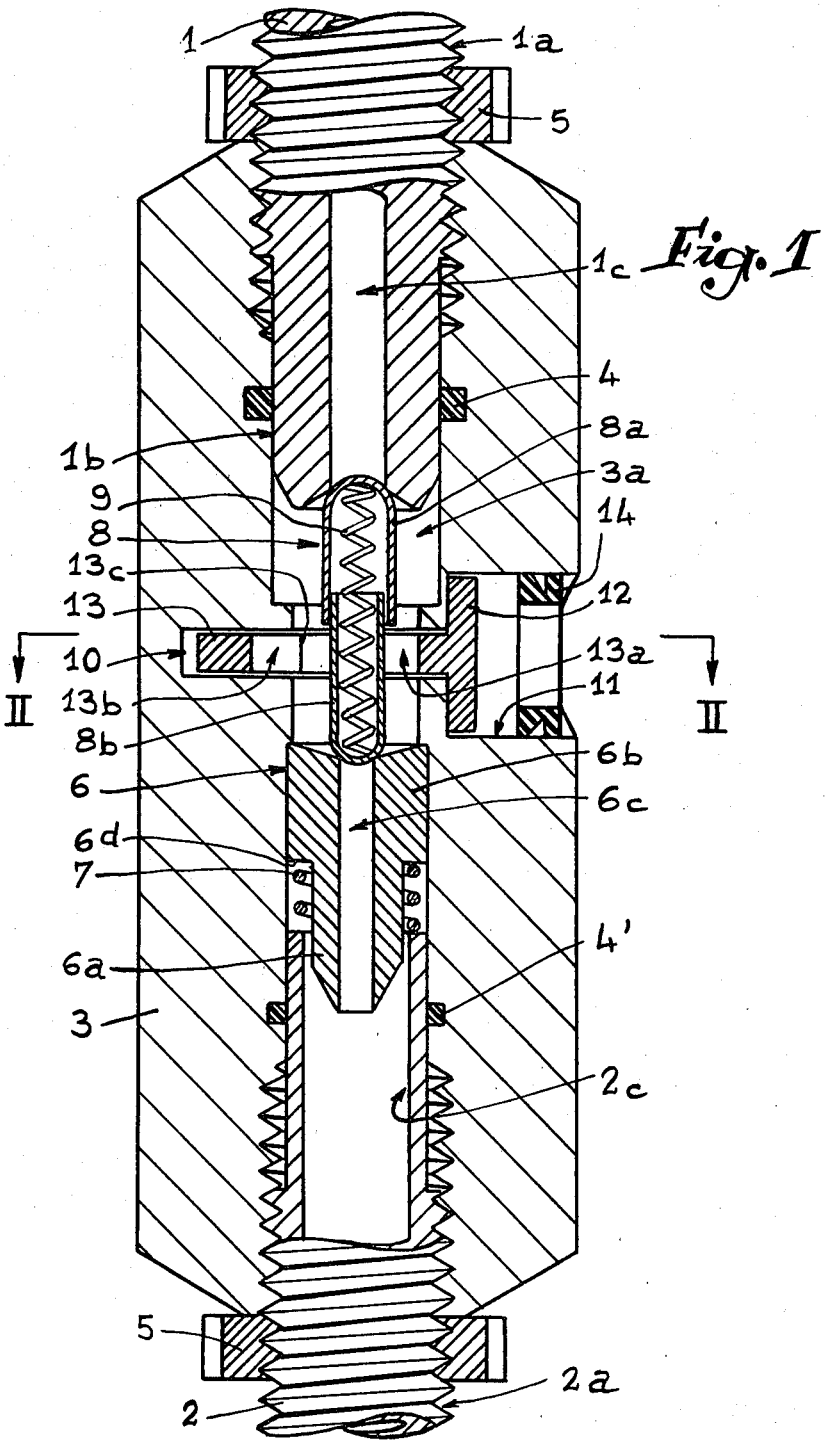
FIG. 1 is a longitudinal section through a double twist spindle provided with a pneumatic threading device according to the invention.

Referring now to the drawings, FIG. 1 shows the central shaft of a double twist spindle composed of two tubes 1,2 whose ends are threaded so as to be connected via a sleeve 3.

It will be observed that the thread 1*a* of tube 1 stops at a short distance from its end to leave a smooth cylindrical bearing surface 1*b* adapted to cooperate with an O-ring 4 of the sleeve 3. A ring 5 cooperates with the thread 1*a* of the tube 1 to determine the relative position of the latter with respect to the sleeve 3.

Similarly, the lower tube 2 comprises a thread 2*a* which stops before the end of the tube to leave a smooth cylindrical bearing surface 2*b*. At this level, the sleeve also comprises an O-ring 4' for reasons which will be explained hereinafter. Said end 2*b* is associated with a stepped end piece 6 bored right through, of which the part 6*a* of smallest diameter penetrates in the bore 2*c* of the tube 2. Between the external shoulder 6*d* of the end piece 6 and the inner annular end of the tube 2 is placed a compression spring 7. The part of the end piece 6 of largest diameter, 6*b*, is mounted to slide in the bore 3*a* of the sleeve 3. The upward opening of the central hole 6*c* of the end piece 6 is bevelled in the same way as the inner end opening of the bore 1*c* of the tube 1. The openings in question are connected by the conventional yarn brake 8 which is composed of a capsule 8 formed by two telescopic tubular elements referenced 8*a* and 8*b* and of which the ends are each closed by a spherical portion. A compression spring 9 is placed between the two elements of the capsule 8 with a view to spacing them apart. Adjustment of the penetration of the tubes 1 and 2 in the sleeve 3 is intended to allow suitable compressing of the spring 9 by penetration of the element 8*b* in element 8*a*.

The sleeve 3 is provided with a transverse passage 10 which passes through its central bore 3*a* to arrive in an outwardly opening cylindrical housing 11. In this housing is engaged a piston 12 with cylindrical head comprising a flat rod 13 which fits with clearance in the passage 10. A stopper 14 closes the outward opening of the housing 11. Thus, the bore 3*a* of the sleeve 3 communicates with said cylindrical housing.

Figure 2:
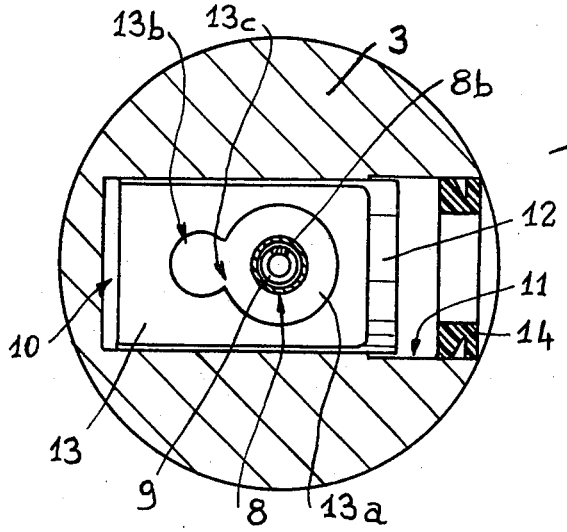
FIG. 2 is a section thereof along II—II (FIG. 1).

FIG. 2 illustrates the particular form of the flat rod 13 of the piston 12. It is substantially rectangular and comprises two intersecting secant circular openings, one, 13*a*, having a diameter larger than that of the other, 13*b*. It will be noted that the outer diameter of the element 8*b* of the capsule 8 has of diameter larger than the width of the slot 13*c* communicating between the two openings 13*a* and 13*b* for reasons which will be explained hereinafter.

Prior to positioning the capsule 8 in the sleeve 3, the piston 12 is placed in the position shown in FIGS. 1 and 2 so that the capsule 8 can pass through the hole 13*a* in the rod 13 of this piston.

Operation of the device follows from the foregoing explanations.

When automatic threading is not occurring, the piston 12 is in the position illustrated in FIGS. 1 and 2, i.e. its head is abutting against the stopper 14 at the outer end of the housing 11 whilst the spherical end portions of the two elements 8*a*, 8*b* of the capsule 8 are in abutment against opposed recessed seats comprising the respective openings of the bore 1*c* of the tube 1 and of the central hole 6*c* of the end piece 6.

Figure 3:
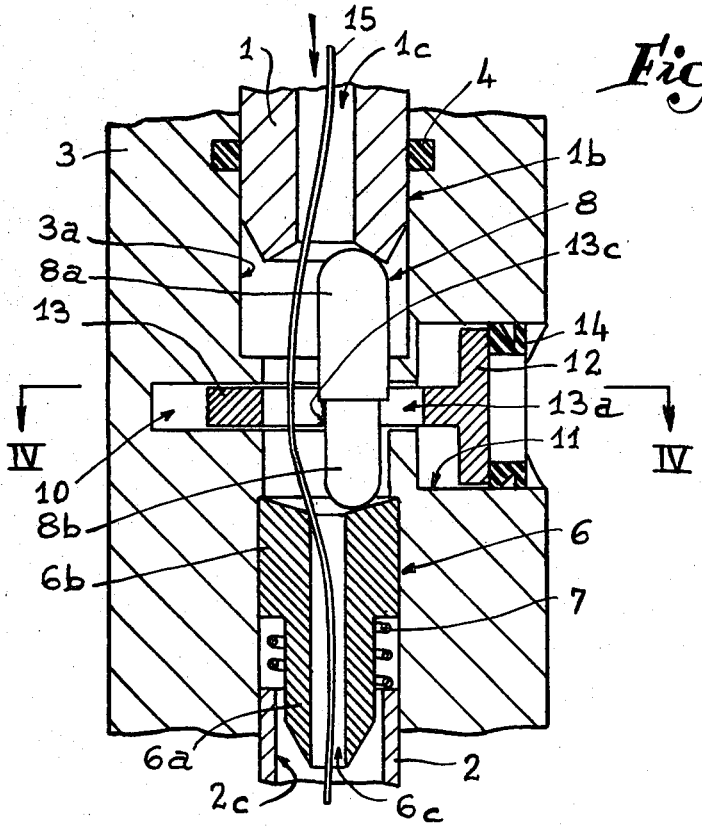
FIG. 3 is a partial view corresponding to FIG. 1 but showing the yarn brake in its retracted position.

If it is desired to introduce a yarn and cause it to pass through the two tubes 1 and 2, a pistol such as the one described in U.S. Pat. No. 4,199,929 but which comprises only one air inlet hole instead of two, is coupled at the upper opening of the bore 1*c* of the tube 1. The air arriving under pressure in the bore 1*c* of the tube 1 penetrates in the space surrounding the capsule 8 and presses against the head of the piston 12 causing it to move towards the right until the head is in abutment against the stopper 14 (FIG. 3). This lateral displacement of the piston causes the rightward displacement of the capsule 8 as a result of which the two elements telescope together against the reaction of the spring 9 so that the opposite openings of the tubes 1 and 2 are exposed. It will be observed that the capsule 8 is moved rightwardly as shown in FIG. 3 by the rod 13 of the piston 12 by abutment of the two edges of the slot 13*c* against the periphery of the capsule 8. Due to the exposure of the openings of the bore 1*c* and the hole 6*c* of the end piece 6, the spring 9 is caused to contract.

Figure 4:
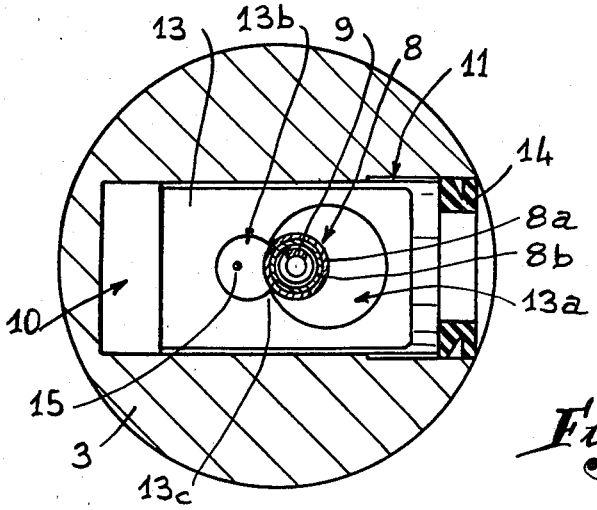
FIG. 4 is a section thereof along IV—IV (FIG. 3).

If a yarn 15 is then introduced at the free end of the bore 1*c*, it is taken along by the compressed air and passes into the hole 6*c* of the end piece 6, then into the hole 2*c* of the tube 2, and finally emerging at the desired place of the double twist spindle having previously passed through the small hole 13*a* in the rod 13 (FIG. 4) which is substantially in the geometrical axis of the two bores 1*c*, 2*c*.

The above-description has been given as if the end piece 6 were fixed to the inner end of the tube 2. In fact, without this being compulsory, it is preferred to use the end piece 6 and the spring 7 so that, once the air has arrived in the chamber formed at the centre of the bore 3*a* of the sleeve 3, it causes a slight descent of the end piece 6 which promotes the lateral displacement of the capsule 8 via the rod 13 of the piston 12.

Of course, the O-rings 4 and 4' prevent escape of air between the sleeve and the tubes 1 and 2 respectively.

Figure 5:
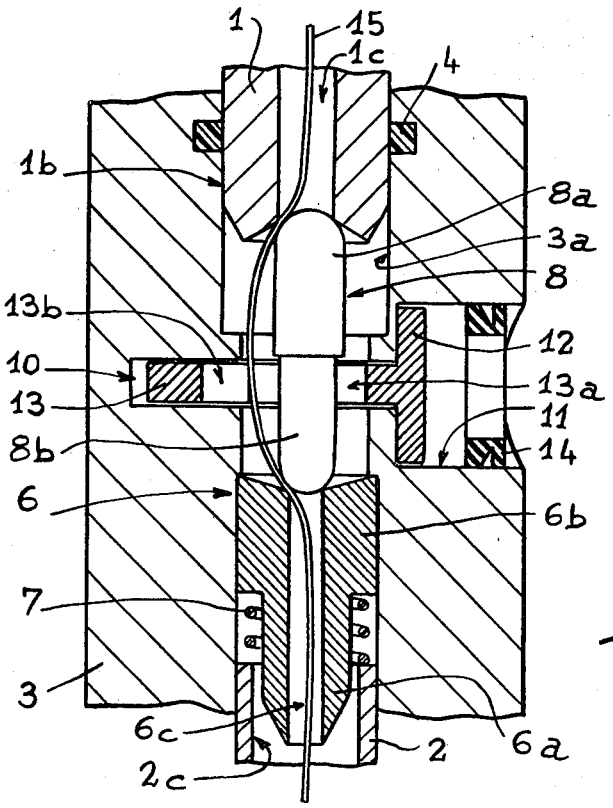
FIG. 5 is a view similar to that of FIG. 3 but showing the yarn jammed by the yarn brake after it has been engaged in the bore of the spindle.

Once the yarn has emerged at the bottom of the spindle, the introduction of compressed air is stopped. The action of the spring 9 with respect to the two telescopic elements 8*a*, 8*b* of the capsule 8 as well, possibly, as the upward displacement of the end piece 6, cause their return towards the centre of the capsule which causes the piston 12 to return to its initial position (FIG. 5), caused by the action of the capsule against the edges of the slot 13*c*. The yarn 15 is then jammed between the two ends of the capsule 8 and the openings of the bore 1*c* of the tube 1 and of the bore 6*c* of the end piece 6.

It is known that the degree of jamming is not very great, but that it is indispensable for balancing the tension of the balloon formed by the yarn around the double twist spindle. The yarn therefore advances between the ends of the capsule 8 and their points of contact by moving peripherally about the two ends in question so that wear of the capsule, the end piece 6 and the tube 11 is regularly distributed.

A device for pneumatically threading the yarn in a double twist spindle is therefore produced which is particularly efficient whilst being of a very modest cost price.

The preceding description has, of course, been given only by way of example and it in no way limits the domain of the invention, replacement of the details of execution described by any other equivalents not departing from the scope of the invention.

What is claimed is:

1. A pneumatic yarn threading device for a double twist spindle having a hollow central shaft with a yarn brake therein, and having means operative when the shaft is pneumatically pressurized for introducing yarn through its bore past the brake, wherein the device comprises:

(a) a shaft comprising axially aligned mutually-spaced tubular portions joined together by a central portion having an axial bore of diameter larger than the bores of said tubular portions, the tubular portions having opposed ends facing each other across the bore of the central portion, and the central portion having a transverse passage extending thereacross between the tubular portions;

(b) a yarn brake comprising an elongated capsule in the bore of the central portion and having opposed ends which are disposed in a first axially aligned position to abut said opposed ends of the tubular portions and close their bores, and the capsule in a second displaced position being offset from axial alignment to expose the bores at said opposed ends to permit yarn to be passed therethrough; and (c) means for controlling the position of the capsule comprising piston means slidably mounted in said transverse passage and having an opening therethrough receiving said capsule, the opening being larger in diameter than the capsule; yieldable spring means urging the capsule and the piston means normally to occupy a first position wherein the capsule is axially aligned with and closes the bores of the tubular portions; and one side of the piston means being pneumatically coupled to the bore of the central portion and operative when the hollow shaft is pressurized to displace the piston means and move the capsule to said second displaced position, whereby yarn can pass through said bores and the opening of the piston means for threading the double twist spindle.

2. The device as claimed in claim 1, wherein said capsule comprises two hollow telescopic elements urged apart by said yieldable spring means; and the ends of said tubular portions carrying opposed recessed seats into which the ends of the capsule are urged by said spring means.

3. The device as claimed in claim 1, wherein said transverse passage of the central portion comprises a rod receiving passage on one side of the bore and an outwardly opening cylindrical housing on the other side of the bore; and said piston means comprising a piston in said housing and a rod extending across said bore into said rod receiving passage, and the opening through the piston means comprising two adjacent holes extending through said rod and mutually intersecting at a slot which is smaller in width than the diameter of the capsule, the capsule passing through the hole which is nearer the piston.

4. The device as claimed in claim 3, further including means in the passage for limiting the displacement of the piston in said second displaced position to a position wherein the other hole in the rod which is located away from the piston substantially aligns with the axial bores through the tubular portions.

5. The device as claimed in claim 1, wherein the end of one of the tubular shaft portions carries a recessed seat to receive one end of the capsule, and the end of the other tubular shaft portion carries a separate end piece slidable in the bore of the central portion and having a recessed seat to receive the other end of the capsule; and said spring means urging the end piece away from said other tubular shaft portion to yieldably urge the capsule into said recessed seats.

* * * * *